United States Patent [19]

DeLorenzi et al.

[11] Patent Number: 4,561,923

[45] Date of Patent: Dec. 31, 1985

[54] METHOD AND APPARATUS FOR AUTOMATICALLY COILING AND TAPING ELONGATED TUBING AND THE LIKE

[75] Inventors: Benjamin DeLorenzi, Budd Lake; Robert B. Comerford, West Millington, both of N.J.

[73] Assignee: Foster & Allen, Inc., Somerville, N.Y.

[21] Appl. No.: 537,659

[22] Filed: Sep. 30, 1983

[51] Int. Cl.[4] ..... B65C 9/36

[52] U.S. Cl. ..... 156/350; 100/4; 100/8; 100/16; 156/361; 156/475; 156/489; 156/492; 156/542

[58] Field of Search ..... 156/541, 542, 584, 361–363, 156/468, 486–492, 446, 350; 100/4, 5, 16, 8, 40; 53/590, 116

[56] References Cited

U.S. PATENT DOCUMENTS

| | | | |
|---|---|---|---|
| 3,175,938 | 3/1965 | Moberg | 156/489 |
| 3,222,240 | 12/1965 | Carter et al. | 156/486 X |
| 3,736,208 | 5/1973 | Kraft et al. | 156/489 X |

*Primary Examiner*—David Simmons

*Attorney, Agent, or Firm*—Louis Weinstein

[57] ABSTRACT

Tubing typically produced by an extruder is advanced to coiling apparatus and is cut to predetermined lengths. The automated apparatus includes a plurality of spindles arranged at spaced intervals about a turret, which is indexed to position each spindle to: receive, clamp and coil the last cut length of tubing; advance the coiled length of tubing to a taping station, where the spindle so advanced is rotated for application of tape at diametrically opposed locations, and advance the spindle to an ejection location, where the spindle ejects the taped coil of tubing. The taper advances a pressure-sensitive tape strip, strips a protective strip from the tape and applies the tape to the applicator surfaces of a jaw assembly which swing together causing the tape to envelope the coiled tubing and presses the ends of the pressure-sensitive tape strip together to complete the taping function. The jaws of the jaw assembly are then separated, and the jaw assembly is withdrawn from the coiled tubing. The spindle undergoes a half-revolution rotation in readiness for a second taping application and withdrawal of the jaw assembly permitting advancement of the taped coil to the ejecting station, completing one cycle of the automated operation.

26 Claims, 18 Drawing Figures

METHOD AND APPARATUS FOR AUTOMATICALLY COILING AND TAPING ELONGATED TUBING AND THE LIKE

BACKGROUND OF THE INVENTION

Flexible plastic tubing is preferably produced in a continuous manner through an extrusion process. It is highly desirable to coil the tubing into predetermined lengths, and to tape each coiled length as the tubing is being extruded. Presently this is done in a manual fashion or its highly labor intensive. It is desirable to perform these activities in an automated fashion, and in such a manner as to keep the coiled tubing sterile and free from contamination, including the pressure-sensitive material employed to tape the coiled tubing.

BRIEF DESCRIPTION OF THE INVENTION

The present invention achieves the above objectives with apparatus characterized by comprising a measuring and cutting assembly, a coiler and a taper assembly.

The measuring and cutting assembly includes pinch rollers, which advance extrudate from the extruder toward the coiler. Adjustably settable measurement means cooperate with the pinch rollers to selectively activate a cutter for cutting the extrudate into predetermined lengths.

The tubing is advanced to the coiler and specifically to one of a plurality of rotatable spindles arranged at spaced intervals about an indexable turret. The spindle receiving the tube length clamps the forward end of the tube and is subsequently rotated to coil the tube length about the coil holding fingers arranged upon the spindle. The tail end of the tube length passes through a tail holder assembly, which grips the tail end of the tube length to prevent the coiled tube length from uncoiling.

The spindle is then advanced from the coiling station to the tape applying station by indexing the turret, so that the spindle reaches the tape applying station, at the time the tube length has been coiled.

The taper includes a supply spool containing an elongated base strip containing tapes having a pressure-sensitive adhesive on one major surface. The protective base strip covers the adhesive surface. The base strip is automatically advanced to apply one tape to the applicator jaws of a jaw assembly as the tape is peeled away from the base sheet by pulling the base sheet about the free end of a tapered plate. The tape is held upon the applying surfaces of the jaw assembly by a vacuum, and the base strip is wound about a take-up spool. An air wand directs air against the tape strip as it is peeled away from the base sheet to urge the tape strip against the applicator jaws.

The jaw assembly comprises a pair of swingably mounted applicator jaws advanced toward the coiled tubing and which are drawn together by operation of an air cylinder to encircle the tape strip about the coil of tubing. The adhesive bearing ends of the tape strip are pressed together, causing the pressure-sensitive surfaces to adhere to one another. The jaws swing apart and the jaw assembly is retracted from the coiled, partly taped tubing, causing the cooperating jaws to separate, leaving the tape strip in place about the coil.

The spindle at the taping station is then revolved through one-half turn after a controlled delay. A second tape strip is advanced to the applicator surfaces of the jaws and is again peeled away from the base strip. The jaw assembly is again advanced toward the coiled tubing, and the jaws are swung together causing the second tape strip to encircle the coiled tubing. The pressure-sensitive adhesive surfaces are pressed together, and the jaws are separated and the jaw assembly is retracted, completing the taping operation. The tape strips are arranged along an imaginary diameter of the coiled tubing.

The turret is again indexed to move the spindle containing the coiled taped tubing to the taped, coiled tubing ejection station, where the taped, coiled tubing is ejected from the spindle into a box, for example. The last-mentioned spindle is thereafter advanced to the tube receiving position, whereupon the operating cycle is automatically and continuously repeated. The provision of a plurality of spindles upon the turret permits the operation to be continuous, in that while a tube length is being coiled on one spindle, a coiled tube length is being taped on a separate independent spindle, and taped length of coiled tubing is being ejected in another separate independent spindle, all at the same time.

The coil forming brackets on each spindle are radially adjustable, and the number of spindle rotations during coiling is selectively adjustable to adjust the coil size and number of the coils, thereby enabling adjustments to accommodate different tube lengths and/or coil sizes.

The coiled tube lengths are maintained taut by coiling the tube lengths at a rate at least slightly faster than the rate at which the tube is fed to the coiler.

OBJECTS OF THE INVENTION AND BRIEF DESCRIPTION OF THE FIGURES

It is, therefore, one object of the present invention to provide apparatus for coiling and taping coiled tube lengths and the like in a fully-automated manner.

Still another object of the present invention is to provide method and apparatus for coiling and taping elongate flexible tubing and the like, comprising rotatable spindles mounted upon an indexable turntable to permit coiling, taping and ejection to occur at respectively different stations substantially simultaneously.

Still another object of the present invention is to provide novel coiling and taping means including at least one rotatable spindle, and a reciprocal jaw assembly cooperating to tape a coiled length of tubing in a fully-automated manner.

Still another object of the present invention is to provide novel taping apparatus for taping coiled tubing matter and the like, comprising a jaw assembly having a pair of swingable jaw members and means for automatically advancing a strip of a pressure-sensitive member to the jaw assemblies; peeling away a protective cover strip; applying the applicator surfaces of the jaw assembly; and severing the delivered strip from the main supply, in a fully-automated fashion.

The above as well as other objects of the present invention will become apparent when reading the accompanying description and drawing in which:

FIG. 1 is an elevational view of the cutter advancer machine and the coiler machine with the taper omitted for purposes of simplicity.

FIGS. 2*a* and 2*b* are detailed front and side views of the coiler of FIG. 1.

FIG. 3 is a side view of the turret driving assembly of the coiler shown in FIGS. 1, 2*a* and 2*b*.

FIG. 3*a* is a detailed view of the slip ring assembly of FIG. 3 looking in the direction of arrows 3*a*—3*a* in FIG. 3.

Figure 6A:
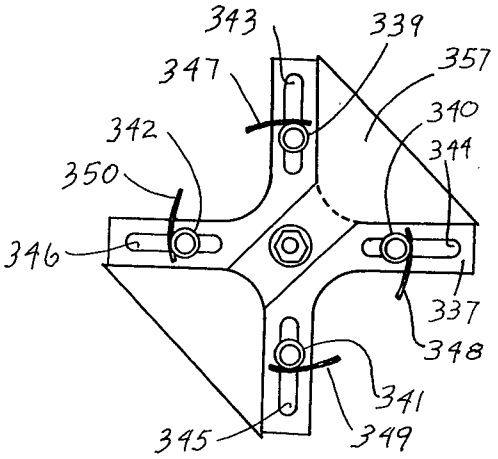
FIG. 6 is a detailed side view of one of the spindle assemblies shown in FIG. 1.
Figure 6B:
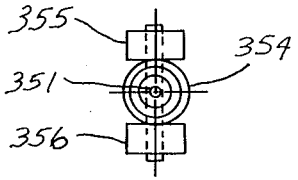
Figure 6:
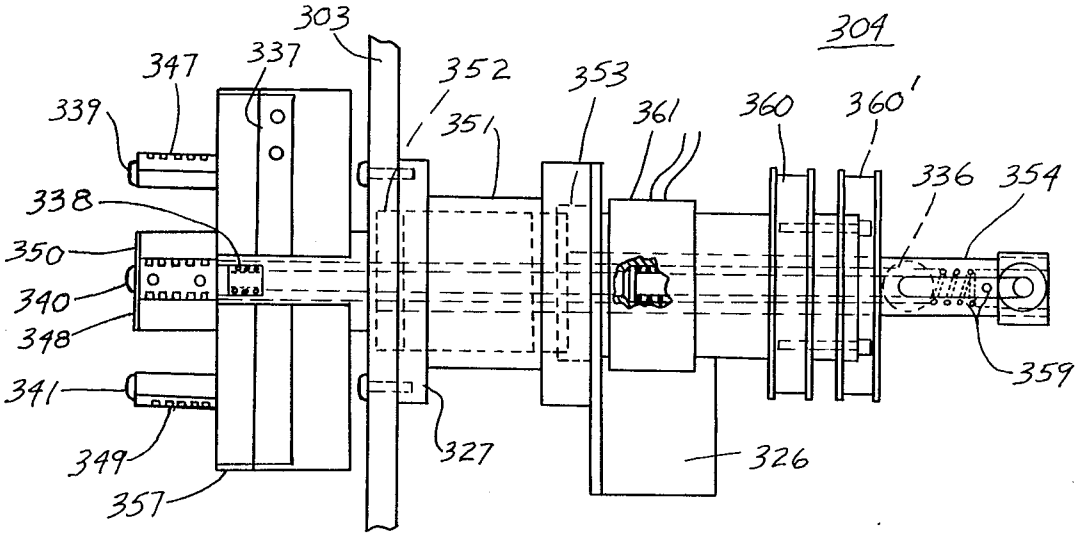

FIG. 6*a* shows a detailed front end view of the spindle assembly of FIG. 6.

FIG. 6*b* is a detailed rear end view of the spindle assembly of FIG. 6.

Figure 1:
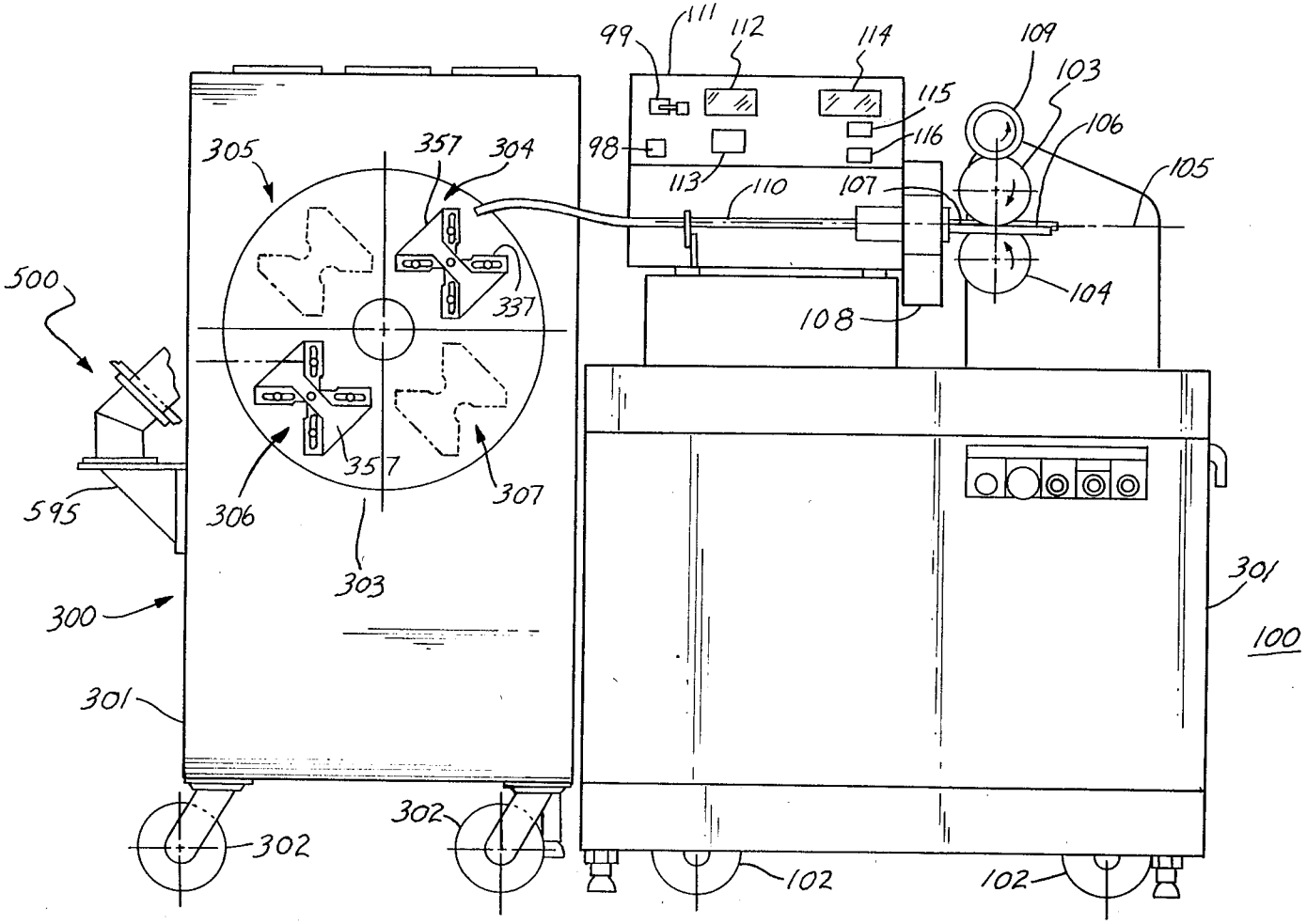
Figure 7:
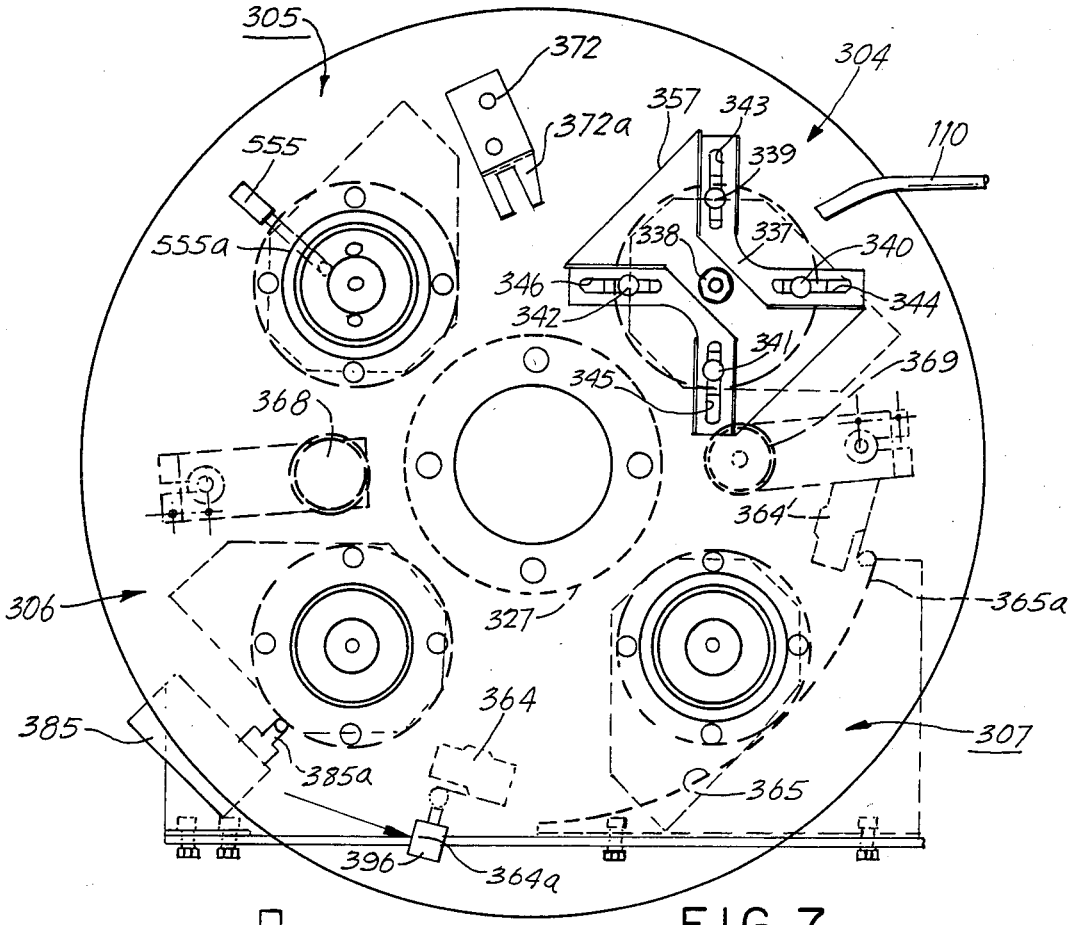

FIG. 7 is an enlarged front view of the turret assembly employed in the coiler of FIG. 1.

Figure 7A:
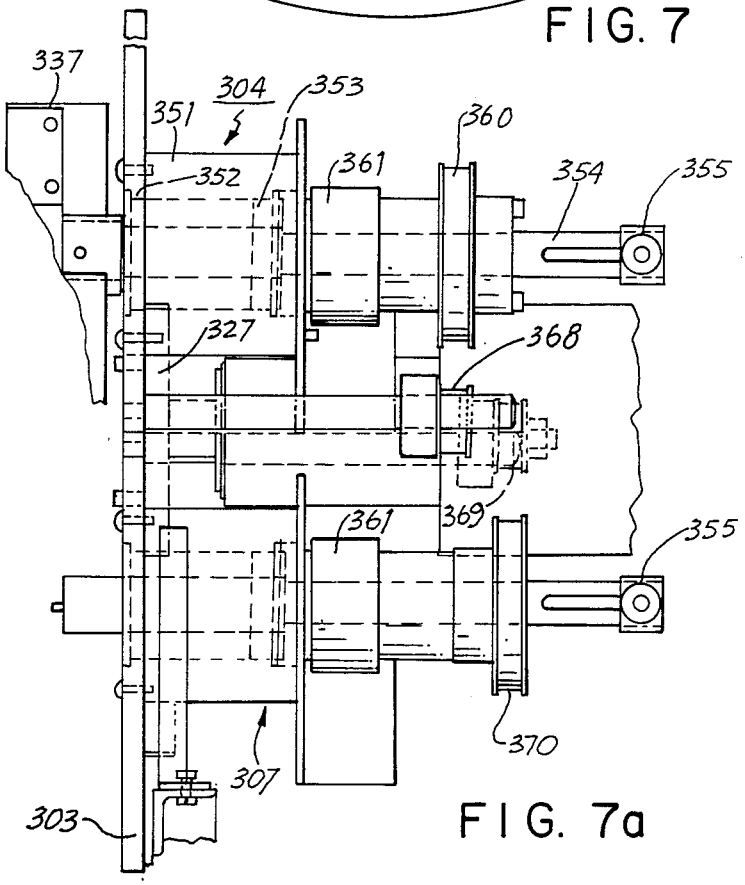

FIG. 7*a* is an end view of the turret assembly of FIG. 7.

Figure 8:
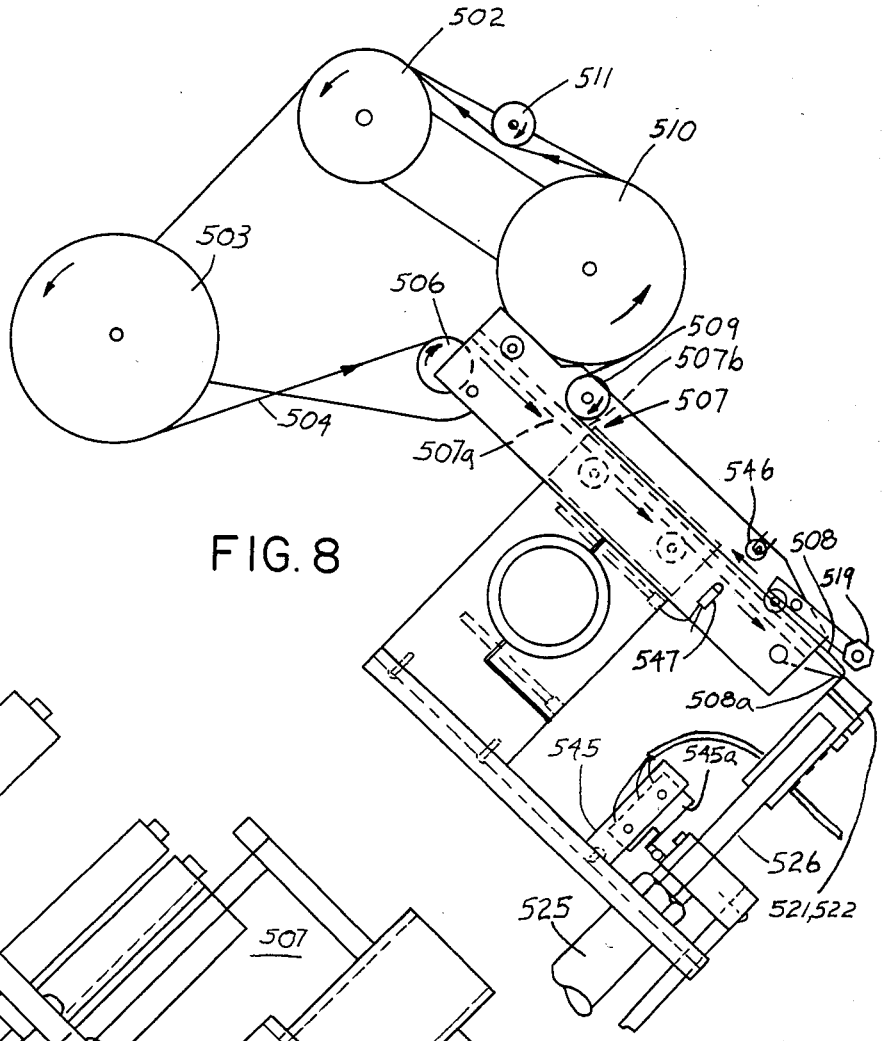

FIG. 8 is a side view of the taper assembly.

Figure 8A:
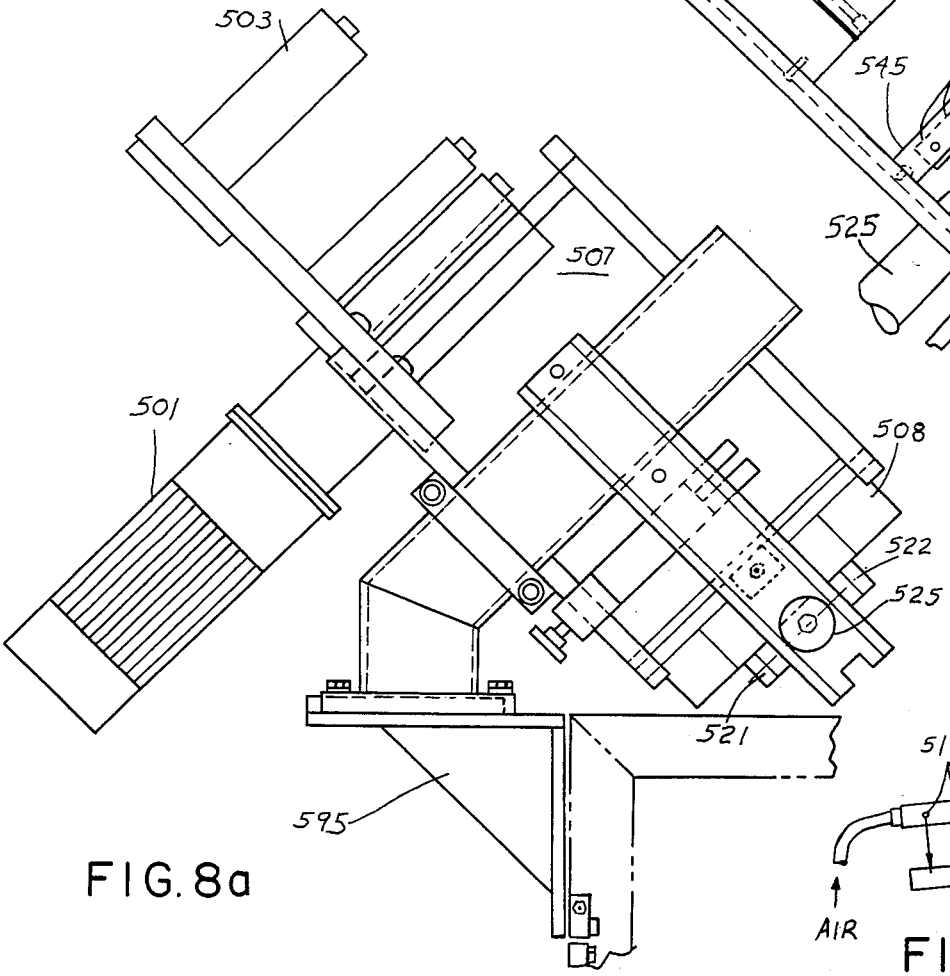

FIG. 8*a* is a rear end view of the taper assembly of FIG. 8.

Figure 8B:
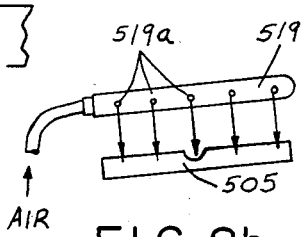

FIG. 8*b* is a perspective view of the air wand of FIG. 8.

Figure 9:
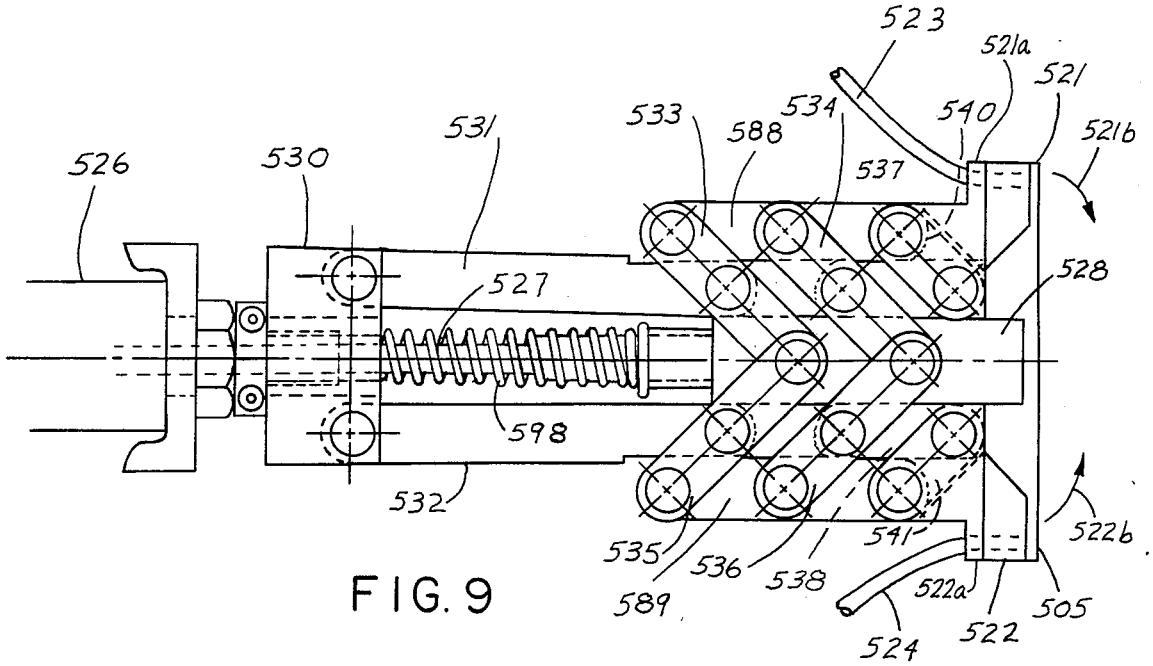

FIG. 9 is a detailed side view of the taper jaw assembly.

Figure 10:
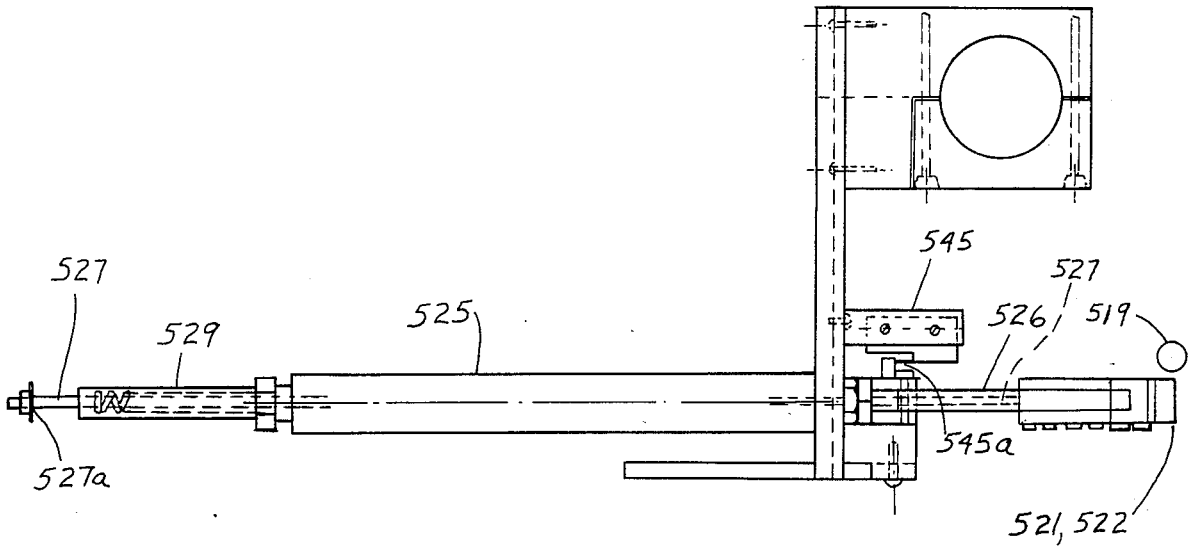

FIG. 10 is an enlarged view of the jaw assembly.

Figure 11:
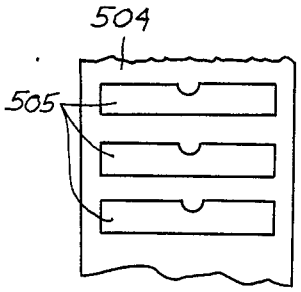

FIG. 11 is a plan view showing a plurality of tapes arranged on a base sheet.

DETAILED DESCRIPTION OF THE INVENTION

FIG. 1 shows a system 10 for advancing, cutting, coiling, taping and ejecting coiled tubing and being comprised of an advancing and cutting machine 100, a coiler 300 and a taper 500. The taper 500 is broken away from FIG. 1 for purposes of simplicity, and is shown in detail in other figures forming part of this application.

The machine 100 is comprised of cabinet 101 mounted upon a set of wheels 102 and supporting a pair of cooperating resilient pinch rollers 103, 104 for advancing tubing 105 being produced by an extruder (not shown) and advanced into the nip between rollers 103, 104 by input guide tube 106. A pulser 109 cooperating with upper pinch roller 103, develops pulses representative of the length of tubing being advanced through the rollers 103, 104. A guide tube 107 guides tubing 105 towards and into cutter 108. Tubing 105 passes through cutter 108, which cuts tubing 105 to the desired length.

Tubing 105 passes through cutter 108 and guide tube 110, and is advanced to a spindle of the coiler 300, located at the tube receiving station. The machine 100 is preferably a Model No. 7021, produced by Versa Manufacturing Company, the assignee of the present invention.

The machine 100 includes a control panel 111 positioned upon cabinet 101 and behind guide tube 110 and includes a digital display 112 for displaying the number of half-turns through which the coiler spindle rotates when coiling tubing; a settable switch 113 for selecting the desired number of half-turns; a digital display 114 for displaying the desired length (in inches) of the tubing between cuts; a settable switch 115 for selecting tubing length; and a selectable switch 116 for setting the length of tubing advanced from the cutter 108 to be sufficient so that the forward end of tubing 105 is clamped by the spindle. The panel 111 also includes OFF switch 98 and ON switch 99.

Figure 2B:
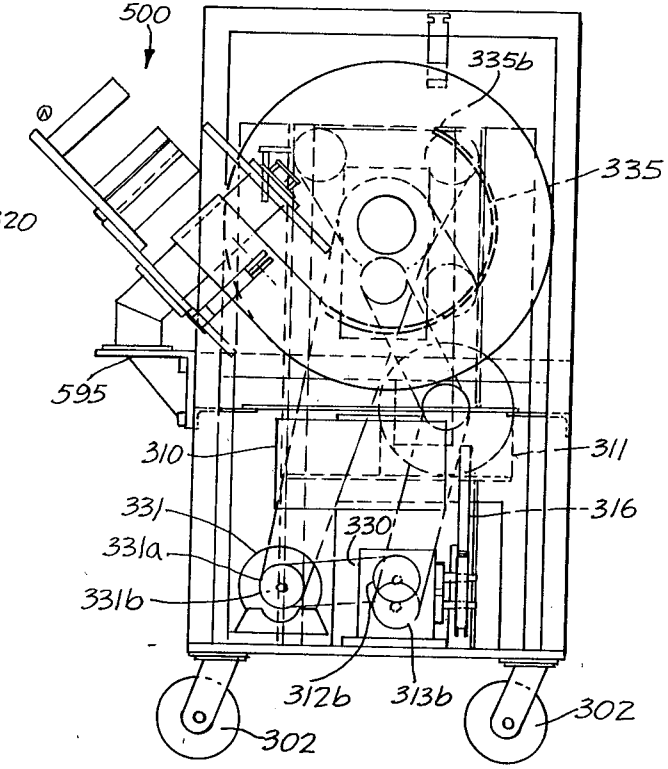
Figure 2A:
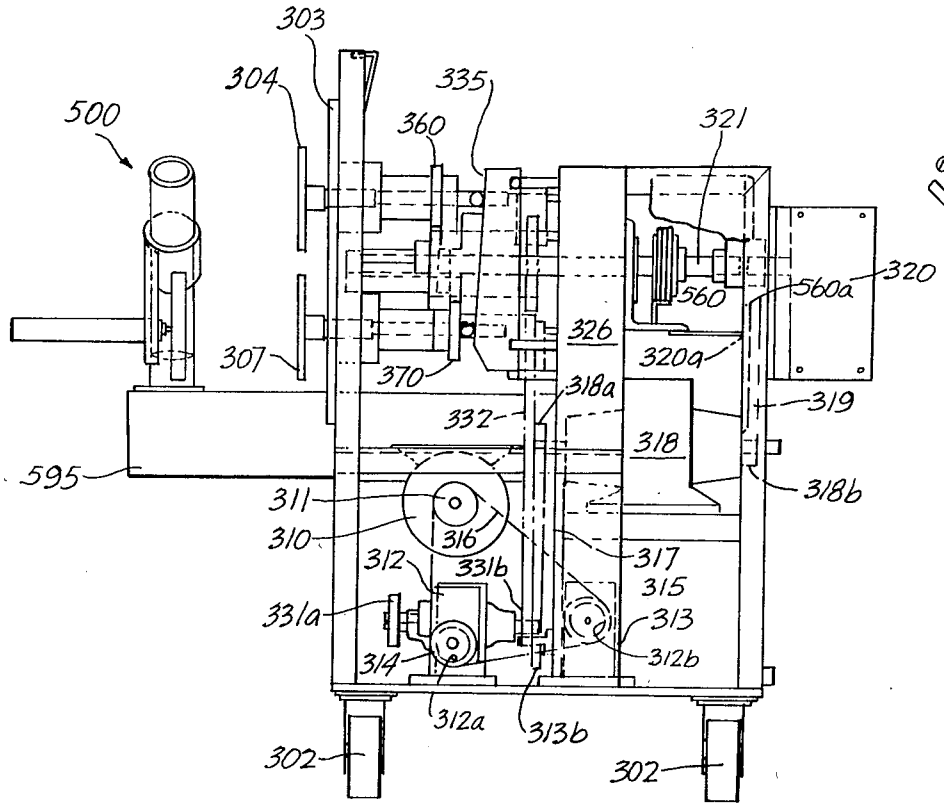

The coiler 300 (FIGS. 1, 2*a* and 2*b*) comprises a cabinet 301 supported by wheels 302 and positioned alongside the cabinet 101 of machine 100. The coiler includes an indexable turret 303 upon which four (4) rotatable and reciprocatable spindles 304–307 are mounted. Since all four spindles are identical in design and operation, only one will be described herein for purposes of simplicity.

The taper assembly 500 is mounted to coiler 300 by bracket 595 and includes the taper and the supply tape and advancing mechanism for advancing tape to the applicator jaws of the jaw assembly. The manner in which the peeling of the tape away from a base strip and applying the tape to the applicator surfaces of the taper jaw assembly will be more fully described hereinbelow.

Coiler 300 includes a drive motor 310 whose output pulley 311 is coupled to the output pulleys 312*a* and 312*b* of speed reducers 312 and 313, respectively, by belt 316.

The ouput pulley 313*b* of speed reducer 313 is coupled through belt 317 to the input pulley 318*a* of clutch/brake 318. The output pulley 318*b* of clutch/brake 318 is coupled through belt 319 to the input pulley 320*a* of indexer 320. The output shaft 320*b* of indexer 320 rotates through one-quarter turn for every full revolution of input pulley 320*a*. Output shaft 320*b* is coupled to shaft 321 through coupler 322 (see FIG. 3).

Shaft 321 is rotatably supported by bearings 323 and 324 in hollow casing 325 secured to a frame member 326 within coiler 300. The forward end of shaft 321 is coupled to mounting plate 327. Turret 303 (FIGS. 1 and 2*a*) is bolted to mounting plate 327.

Figure 3A:
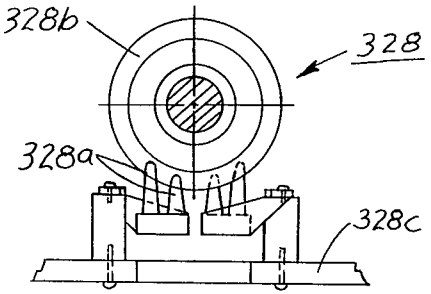
Figure 3:
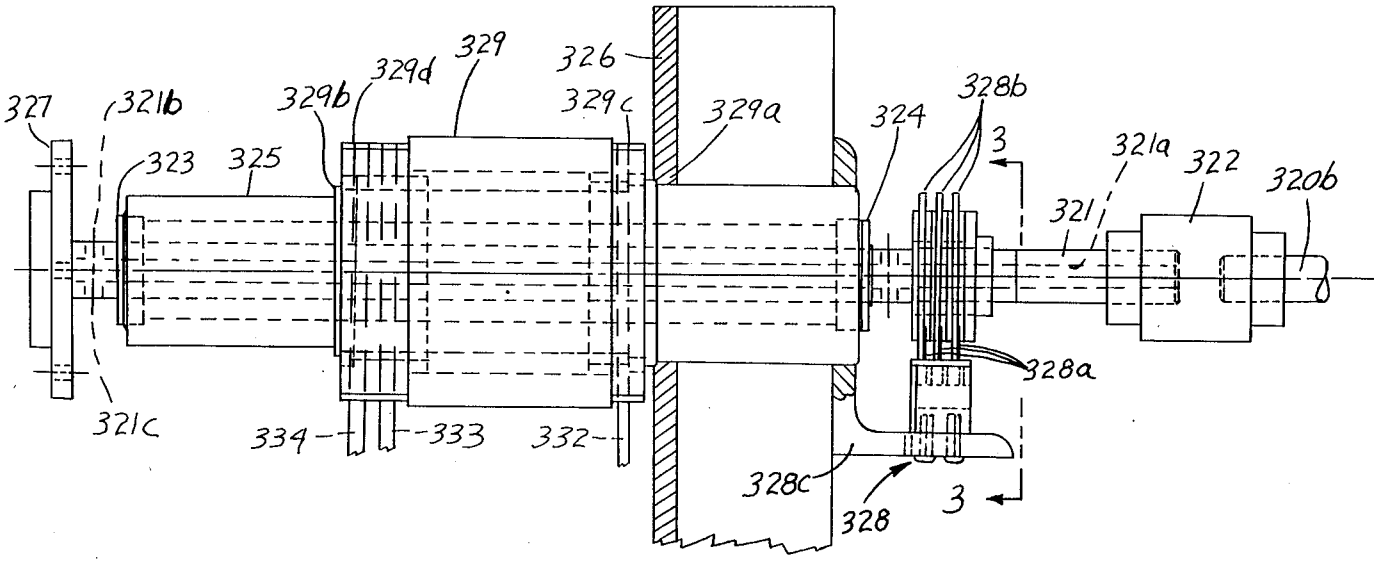

Electrical power is coupled to the electrical clutches provided in each spindle assembly 304–307 by a slip-ring assembly 328 (see FIGS. 3 and 3*a*). Electrical leads are coupled to stationary terminals 328*a* mounted upon bracket 328*c*, which terminals wipingly engage rings 328*b*, which rotate with shaft 321. Rings 328*b* are each connected to an associated wire (not shown), each wire extending through the length of the hollow interior 321*a* of shaft 321. The wires pass out through radially aligned openings 321*b*, 321*c* at the forward end of shaft 321 for connection to the electrical clutches of the spindle assemblies 304–307 (to be more fully described).

A hollow cylindrical-shaped quill 329 is rotatably mounted upon casing 325 is supported on bearings 329*a*, 329*b* and rotates independently of shaft 321 and casing 325. A belt 330 couples pulley 312*b* of speed reducer 312 to the input pulley 331*a* of a magnetic particle clutch 331, whose output pulley 331*b* is coupled through belt 332 to quill 329, to rotate quill 329. Belt 332 extends about the rear portion 329*c* of quill 329. Magnetic particle clutch 331 provides the desired tension for coiling the tubing and is designed to "slip" when tube 105 is placed under too much tension.

Belt 333 entrained about the forward end portion 329*d* of quill 329 is entrained about an input pulley 360 of each of the two spindle assemblies 304, 305. Belt 334 is also entrained about the forward position 329*d* of quill 329 and the input pulleys of each of the remaining spindle assemblies 306, 307.

Figure 4:
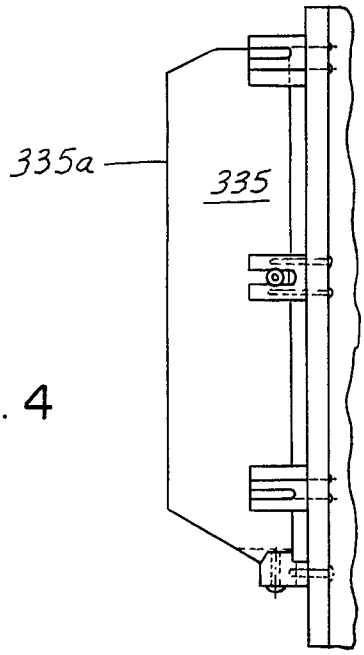
FIG. 4 is an enlarged side view of the cam shown in FIGS. 2*a* and 2*b*.

An arcuate cam 335 (FIGS. 2*a*, 2*b* and 4) secured to frame 326 of coiler 300 (FIG. 2*a*) controls the forward and rearward reciprocating movement of spindle assemblies 304–307, as will be more fully described.

The spindle assemblies 304–307 are substantially identical and only one will be described in detail for purposes of simplicity. Noting FIGS. 6, 6*a*, 6*b*, 7 and 7*a*, center shaft 336 has its forward end secured to bow-tie shaped plate 357 by nut 338. A finger plate 337 cooperates with plate 357 and has fingers 339–342 mounted upon finger plate 337 and movable along radially aligned elongated slots 343–346 to adjust the size of the coil of tubing 105. Curved plates 347–350 (FIG. 6*a*) may be mounted to fingers 339–342 to urge the coiled tubing into a more rounded configuration.

Figure 5:
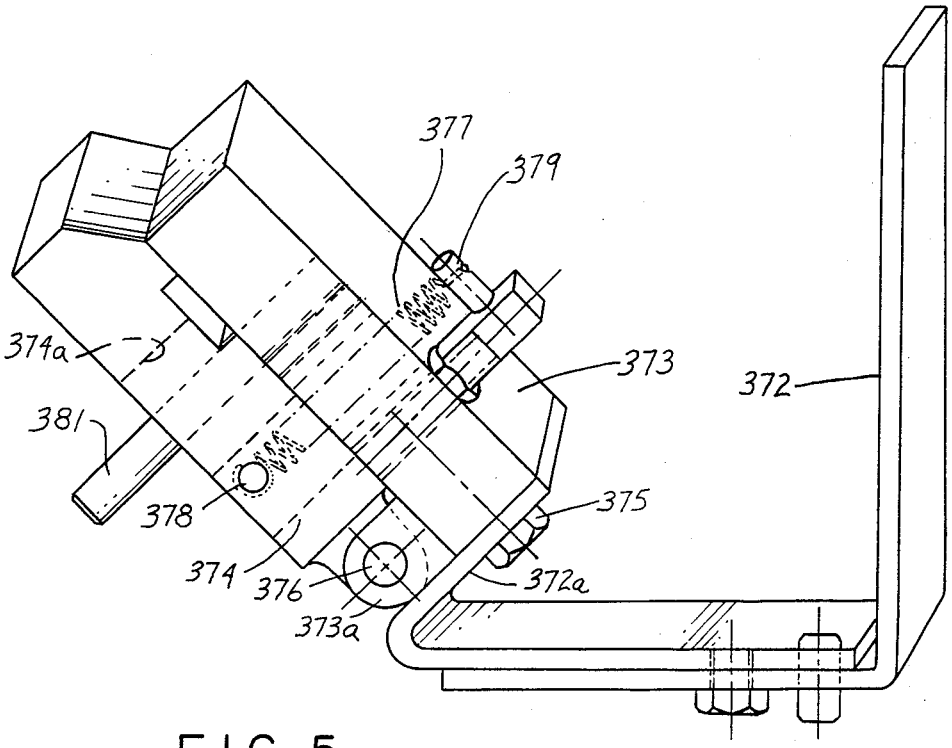
FIG. 5 is an enlarged perspective view of one of the tail keepers employed on the coiler of FIG. 1.

Housing 351 (FIGS. 6, 7*a*) contains bearing 352–353 for rotatably mounting a hollow shaft 354 which receives shaft 336 through its hollow interior. A pair of rollers 355–356 are coupled to the rear end of hollow shaft 354 (FIGS. 6, 6*b*). One of the rollers engages the cam surface 335*a* of cam 335 (FIGS. 2*b* and 5) to move shaft 336 forwardly against the force of return spring 359 to move bow-tie plate 357 away from finger plate 337. When the forward end of tubing 105 is advanced by tube guide 110, it enters into the space between finger plate 337 and bow-tie plate 357. At that time, the length of tubing reaches the value set by the control panel causing the turret 303 to be indexed one-quarter turn counterclockwise (relating to FIG. 1), causing the roller 355 (or 356) engaging cam surface 335 to move off of cam surface 335*a*, allowing bow-tie plate 357 to move toward finger plate 337 under the force of spring 359 applied to center shaft 336, thus clamping the forward end of tubing 105 between bow-tie plate 357 and finger plate 337.

Pulley 360 is constantly driven by quill 329 (FIG. 3) through belt 334. A normally disengaged electric clutch 361 couples drive power from quill 329 coupled to pulley 360, to outside shaft 354, upon receipt of a signal indicating that the spindle assembly should be rotated.

Rotation of a spindle assembly is initiated when the turret 303 is indexed one-quarter turn counterclockwise causing the switch arm 364*a* of switch 364 (FIG. 7) mounted on turret 303 and associated with spindle assembly 304 to move onto cam surface 365. Switch 364 closes an electric path to electric clutch 361, which then engages coupling power to outer shaft 354. Hollow shaft 354 and inner shaft 336 rotate in unison.

Spindle assembly 304 stops rotating when the count of half turns reaches the preset count. Each spindle assembly 305–307 is similarly associated with a switch similar to switch 364. Note, for example, switch 364' associated with spindle assembly 304 (FIG. 7).

The pulleys 368 and 369 (FIGS. 7 and 7*a*) are tensioner pulleys each providing the desired amount of tension for belts 333 and 334 (FIG. 3) coupling drive power from quill 329 to the spindle input pulleys, such as pulley 360 shown in FIG. 6. Pulley 360' in FIG. 6 represents the alternative position which may be occupied by pulley 360 when that spindle assembly engages the other belt. FIG. 7*a* shows pulleys 360 and 370 of spindle assemblies 304 and 307 to better illustrate this arrangement.

The tubing 105 is coiled when the spindle assembly 304 reaches the position occupied by assembly 305 (see FIG. 7). To retain the tubing coiled, a tail keeper assembly is provided for each spindle assembly. One such assembly 371 will now be described.

The assembly 371 (see FIGS. 5 and 7) comprises a bracket 372 secured the turret 303 and supporting a jaw assembly comprised of jaws 373, 374 at free end 372*a*. Jaw 373 is secured to bracket 372 by fastener 375. Jaw 374 is swingably mounted to jaw 373 by a pin 376 extending through arms such as arms 373*a* in jaw 373 and an opening in jaw 374. A spring 377 is stretched between a pin 378 on jaw 374 and a pin 379 mounted on jaw 373 and urges the jaws 373, 374 to the closed position. After the forward end of the tubing is clamped, turret 303 moves spindle assembly 304 moves one-quarter turn counterclockwise. The tail keeper 371 associated with and following spindle 304 moves through the path occupied by tubing 105, i.e., moves across the forward end of guide tube 110 (FIG. 7). Tubing 105 splits the jaws 373, 374 apart and slides between the jaws 373, 374 as the spindle 304 coils the tubing. When coiling is completed, the tail keeper 371 holds the rearward end of the coiled tubing and prevents it from uncoiling. Pin 381 serves as a guide to maintain jaw 374 in alignment with jaw 373 and the elongated slot 374*a* in jaw 374 cooperates with pin 381 to limit the amount of rotation of jaw 374 experiences relative to jaw 373.

When spindle 304 goes through one-half revolution during the taping operation, this releases the rearward end of tube 105 from the tail keeper 371. The taped coil is ejected from the spindle 304 at the ejection station as one of the rollers 355 (or 356) rides upon cam surface 335*a*, causing the bow-tie plate 357 to push the coiled tubing off of the spindle 304.

When the tubing is coiled, the spindle 304 moves to the position occupied by spindle 306 (FIGS. 1 and 7), i.e., the taping station.

The switch arm 385*a* of switch 385 is engaged by the bearing housing of the spindle 304, which has moved to the taping position occupied by spindle 306 (FIG. 7), serving as an interlock to allow a taping operation only when a spindle has advanced to the taping position.

The taper 500 is shown in FIGS. 8, 8*a*, 9, 10 and 11, and comprises a stepper motor 501 for rotating a take-up spool 502. A supply spool 503 has a base sheet which is unwrapped from the supply spool during a tape feeding operation.

FIG. 11 shows a portion of base sheet 504 which is wrapped about supply spool 503 and contains a plurality of tapes 505 arranged at spaced intervals along base sheet 504 with their adhesive surfaces against base sheet 504. Sheet 504 extends from supply spool 503 around roller 506 (FIG. 8) along one surface 507*a* of elongated plate 507, around the forward end 508*a*, tapered peeler guide 508, along the opposite surface 507*b* of plate 507, around small diameter roller 509, around large diameter roller 510, and around small diameter roller 511, to be wound about take-up spool 502.

As the base sheet 504 is pulled around the then leading edge 508*a* of tapered peeler guide 508, although the base sheet follows the curvature of guide 508, the tape 505 does not and is "peeled" away from base sheet 504. Resilient plate 508*a* presses against plate 508 and holds the tape 505 as it starts to "peel" away from base sheet 504. The tape 505 is then positioned above the rubber applicator surfaces 521, 522 of the tape jaw 520 (see FIG. 10).

An elongated air wand comprised of a thin cylinder 519 (FIGS. 8 and 8*b*) is provided with a plurality of spaced openings 519*a*, which release air under pressure directed toward the applicator surfaces 521, 522 to urge the peeled tape 505 against the applicator surfaces 521, 522.

A vacuum is applied to openings in the applicator surfaces 521, 522 through tubes 523, 524 coupled to a vacuum source to hold the tape against rubber applicator surfaces 521, 522 during taping (FIG. 10).

An air cylinder 525 (FIGS. 8 and 9) receives air under pressure to drive its piston rod 526 toward the right in FIG. 9, moving the entire jaw assembly including the applicator surfaces towards the coiled tubing in the position originally occupied by spindle 306 in FIG. 7. The piston rod 526 is hollow and slidably receives an inner shaft 527 which has its forward end connected to a block 528 (FIG. 10). The inner shaft 527 moves to the right (relative to FIG. 9), until a washer strikes the end of stationary tube 529, halting the movement of inner shaft 527 and hence block 528 (FIG. 10). Piston rod 526, however, continues to move forward and its forward end, connected to block 530, moves block 530 forward. Arms 531, 532 are pivotally mounted to block 530 and are also pivotally mounted to block 528 by link arms 533–534 and 535–536, respectively. Blocks 588 and 589 are also pivotally connected to links 533–534 and 535–536, respectively. Arms 531 and 532 thus move to the right and also swing apart slightly (relative to FIG. 10), also causing blocks 537 and 538, pivotally coupled to links 534, 536 and blocks 588 and 589 coupled to links 533–534 and 535–536 to move forward. The applicator blocks 521*a* and 522*a*, supporting resilient applicators 521, 522 include link portions 540 and 541 driven by blocks 537 and 538 to rotate clockwise and counterclockwise, as shown by arrows 521*b* and 522*b*, whereupon the rubber applicator surfaces 521 and 522 move the tape 505 about the coiled tubing and into adhesive engagement.

The air cylinder 525 is then released leaving the tape 505 about the coiled tubing and removing the applicator jaws from their position encircling the coiled tubing under the force of spring 598. The entire jaw assembly is retracted to the start position, allowing the spindle 304 to rotate through one-half turn for application of a second tape diametrically opposed to the location of the first tape.

The switch 385, when first activated, triggers a circuit 396 (FIG. 7) comprised of a time delay relay and a solenoid. The triggering of circuit 396 energizes the time delay relay. After approximately one second, the time delay relay energizes the solenoid which "taps" switch arm 364*a* once, causing the switch 364 to drive spindle 304 through one-half turn by activating electrical clutch 361 (FIG. 6). It should be understood that the actual position of switch 364 associated with spindle 304 will be one-half turn (180°) from its position as shown in FIG. 7, and that circuit 396 will be adjacent thereto, these circuits being shown in the position of FIG. 7 merely for purposes of simplicity.

The switch arm 545*a* of switch 545 (FIG. 10) operates to close switch 545 to prevent the spindle 304 from rotating until the jaw assembly is fully retracted from the spindle.

A light source 546 and light detector 547 control stepper motor 501 to advance only one tape 505 each time the light detector 547 "sees" the light through base sheet 504 and between a pair of adjacent tapes 505.

The switch arm 555*a* of a switch 555 (FIG. 7) is engaged by the rollers 355, 356) at the rear end of each spindle 304–307, each time the spindle rotates through one-half turn. These switch closures are counted and displayed by the half turns display 112 (FIG. 1). When the desired number of turns is completed the turret 303 is indexed one-quarter turn to move the spindle with the coiled tubing to the taping position (spindle 306).

The switch arm 560*a* of switch 560 (FIG. 2*a*) is engaged by a projection on pulley 320*a* of indexer 320 when pulley 320*a* has rotated through one full turn to apply a signal to the clutch/brake 318 to turn the clutch off (i.e., disengaged) and to turn the brake on to abruptly stop the turret after it moves through one-quarter turn to accurately index the turret 303.

Briefly, the operation of the present invention is as follows:

Tubing 105 from the extruder is advanced through the input and output guide tubes, so as to be engaged by the pinch rollers 103, 104. The tubing is further threaded through guide tube 110. The length of tubing necessary to place the forward end of the tubing between the spaced apart bow-tie plate 357 and the finger plate 337 is fixed in lower switch assembly 115. The length of tubing desired to be coiled is fixed in upper switch assembly 116.

The length of tubing, measured by pulser 106, and sufficient to place the forward end of tubing 105 between the bow-tie plate 357 and the finger plate 337, causes a signal to be applied to the clutch/brake 318 (FIG. 2*a*), causing the indexer 320 to drive turret 303 through one-quarter turn. Switch 560 (FIG. 2*a*) is operated by the projection provided on the indexer input pulley 320*a* to turn off the clutch of the clutch/brake, and to turn on the brake of the clutch/brake. During indexing, the spindle 304 receiving the forward end of tubing 105 has one of its rollers 355 or 356 engaged by cam surface 335*a*, causing the forward end of tubing 10 to be clamped between bow-tie plate 357 and finger plate 337. Switch 364 associated with spindle 304 engages cam surface 365, which causes the electric clutch 361 of spindle assembly 304 to be engaged causing rotation of the spindle outer shaft 354 and hence, rotation of the bow-tie plate 357 and finger plate 337, causing the tubing to be coiled about the fingers 339 through 342 (FIG. 7).

The rollers 355 and 356 operate switch arm 555*a* of switch 555, which counts the number of half turns experienced by the spindle assembly 304 (now in the position of spindle assembly 305). This number is displayed in display 112. As soon as the required number of half turns has occurred, the clutch 361 for spindle 304 is de-energized to halt rotation of spindle 304. Turret 303 may now be triggered to index one-quarter turn when the preset count of spindle half turns has been reached, and when the forward end of the next piece of tubing reaches the clamping station (i.e., the position occupied by the spindle 304 in FIG. 7). When turret 303 is indexed one-quarter turn counterclockwise, the spindle assembly 304 moves to the position originally occupied by spindle assembly 306, in readiness for a taping operation.

Switch arm 385*a* of switch 385 which serves as an interlocking means, prevents the taping operation from being initiated until and unless the turret 303 has moved through one full quarter turn to occupy the position originally occupied by spindle 306.

When spindle 304 arrives at the taping position, air cylinder 525 is operated, causing the jaw assembly to be moved toward the coiled tube and ultimately causing the applicator surfaces to swing together, which causes the tape 505 to encircle the coiled tubing, whereupon the adhesive surfaces of the ends of tape 505 are pressed together.

Previous to activation of the air cylinder 525, as described above, and upon completion of the previous taping operation of the coiled tubing upon spindle 305, for example, stepper motor 501 was actuated and advanced the base sheet 504, causing a tape 505 to be peeled from base sheet 504 and urged against the applicator surfaces 521, 522 by the air emitted from air wand 519. The tape 505 is held against the applicator surfaces 521, 522 by a vacuum applied thereto through appropriate conduits. The tape 505 is now in position for application to the coiled tubing and is applied as described above.

Thereafter, air cylinder 525 is operated to swing open the applicator surfaces 521, 522 of the jaw assembly and then retract the jaw assembly from the coiled tubing, whereupon the switch 545 mounted upon the taper assembly 500 enables the spindle 304 to undergo one-half turn, whereupon the taping operation is again repeated.

When the jaw assembly has opened and retracted for the second time, the turret 303 is indexed one-quarter turn counterclockwise, so that the spindle 304 moves to the position originally occupied by spindle 307, whereupon one of the rollers 355 or 356 rides up upon cam surface 335*a*, causing bow-tie plate 357 to be moved forwardly, thereby unclamping the forward end of tubing 105 and ejecting the coiled taped tubing from the spindle assembly.

When the proper length of tubing is again fed through guide 110, so that its forward end is arranged between bow-tie plate 357 and finger plate 337, causing the spindle presently occupying the position originally occupied by spindle 304 to be advanced to the coiling station, the spindle 304 then returns to its original position in readiness for receiving another length of tubing.

Although the present invention is highly advantageous for use in coiling and taping lengths of flexible tubing, the present invention may also be utilized to coil and tape lengths of other elongated, flexible extruded material.

A latitude of modification, change and substitution is intended in the foregoing disclosure, and in some instances, some features of the invention will be employed wihtout a corresponding use of other features. Accordingly, it is appropriate that the appended claims be construed broadly and in a manner consistent with the spirit and scope of the invention herein.

What is claimed is:

1. Apparatus for coiling and taping lengths of a flexible strip comprising:

indexable turret means having a plurality of spindle means rotatably mounted upon said turret means;

means for advancing said flexible material towards a first spindle means station;

said turret means including means responsive to feeding of the forward end of said strip to a predetermined location for indexing said turret means;

first cam means;

said spindle means including clamping means having roller means engaging said cam means when said turret means is indexed to clamp the forward end of said strip to said spindle means;

drive means;

second cam means;

means engaging said second cam means when said turret means is indexed to couple said drive means to said spindle means for coiling said strip about said spindle means;

said spindle means including means responsive to rotation of said means through a predetermined angle for decoupling said drive means from said spindle means;

taper means including switch means responsive to indexing of said turret means to the taping station for activating said taper means;

said taper means including jaw means having swingable applicator jaws;

means for moving said jaw means;

said jaw means including means responsive to said jaw moving means for initially moving said applicator jaws adjacent to said coiled strip and thereafter swinging the applicator jaws together for taping said coiled strip.

2. The apparatus of claim 1, wherein said taper means further comprises a supply spool of tape including a base strip having tape strips adhesively mounted thereon;

a take-up spool;

means for advancing said base strip from said supply spool to said take-up spool;

a peel away guide plate having a tapered end adjacent said applicator jaws;

said base strip being pulled along one side of said guide plate around said tapered end and along the other side of said guide plate as it moves between said supply and said take-up spool, causing a tape to be peeled away from the base strip as the portion of the base strip carrying the tape moves around the tapered edge of said guide plate.

3. The apparatus of claim 1 further comprising an air wand adjacent the tapered edge of said guide plate for directing air against the tape as it is peeled away from the base strip and urging the tape toward said applicator jaws.

4. The apparatus of claim 3, wherein said applicator jaws are formed of a resilient compressible material;

each jaw having an opening;

conduit means coupling said openings to a vacuum source for holding a tape against said applicator jaws.

5. The apparatus of claim 1, wherein said jaw means comprises:

a first and second blocks;

a pair of elongated arms, each having their first ends pivotally connected to said first block;

short linkage arms coupling the opposite ends of said elongated arms to said second block;

linkage arms coupling said applicator jaws to said elongated arms for swingably moving said applicator jaws together when said first and second blocks are moved toward one another.

6. The apparatus of claim 5 further comprising an operating rod extending through and freely movable within an opening in said first block and having a first end coupled to said second block.

7. The apparatus of claim 6 further comprising a hollow rod having a first end secured to said first block and having its central axis aligned with the opening in said first block;

said operating rod extending from said second block towards and through the opening in said first block and into the hollow interior of said hollow rod.

8. The apparatus of claim 7, wherein said jaw moving means further comprises means for moving said hollow rod relative to said operating rod for moving the applicator jaws together.

9. The apparatus of claim 8 further comprising spring means surrounding said operating rod and extending between the first end of said operating rod and said first block for normally urging said first block away from said second block.

10. The apparatus of claim 9, wherein said jaw moving means comprises an air cylinder for driving said hollow rod;

said hollow rod and said operating rod extending into said air cylinder;

a stop engaging the second end of said operating rod for limiting movement of the operating rod as it advances toward the coiled strip tp be taped;

said air cylinder initially driving both said operating rod and said hollow rod toward the coil strip and thereafter driving only the hollow rod when said operation rod engages said stop to move said applicator jaws together against the force of said spring means.

11. The apparatus of claim 2 further comprising resilient holding means cooperating with said guide plate for holding the tape strips between said resilient holding means and said guide plate as said tape strip is being peeled away from the base strip.

12. The apparatus of claim 1 further comprising means for rotating said spindle means through one-half turn a predetermined time after the first tape is applied at the taping station in readiness for a second taping operation.

13. The apparatus of claim 1 further comprising a main shaft for rotatably supporting said turret;

means for selectively coupling drive to said main shaft and means for limiting rotation of said main shaft to one-quarter turn;

hollow, indpendently rotatable quill means;

said main shaft extending through said quill means;

input belt coupling drive to said quill means and at least one output belt coupling drive to the input said spindle means;

each spindle means having a clutch means for selectively coupling the drive power to the output of said spindle means for rotating the spindle.

14. The apparatus of claim 13 further comprising switch means mounted on said turret means;

stationary cam means engaging said switch means when the spindle means associated with said switch means is in the coiling position for energizing the clutch means of the associated spindle means.

15. The apparatus of claim 1, wherein said cam means moves the clamping means of the spindle means to the unclamped position to eject a coil tube from said spindle means when the spindle means is moved to an ejection station by said turret means.

16. The apparatus of claim 1, wherein said spindle means comprises adjustable fingers for adjusting the size of the coil of the strip which is wrapped about said fingers during coiling.

17. The apparatus of claim 1, wherein said spindle means comprises a hollow outer shaft and an inner shaft extending through said outer shaft;

a finger plate coupled to the outer end of said outer shaft;

a bow-tie plate coupled to the outer end of said inner shaft;

spring means normally urging said bow-tie plate toward said finger plate;

roller means coupled to the inner shaft for moving said bow-tie plate away from said finger plate when said roller means engages said first cam means and for enabling the bow-tie plate and finger plate to come together under the force of said spring means when said roller means moves away from said first cam means.

18. The apparatus of claim 1, wherein the spindle means coils said strip at a rate to place the strip under tension;

the drive means for rotating said spindle means comprising slip clutch means arranged to "slip" when the tension experienced by said strip exceeds a predetermined value.

19. The apparatus of claim 13 further comprising a slip-ring assembly arranged upon said main shaft for coupling electric power to the clutch means of said spindle means.

20. The apparatus of claim 1, wherein said drive means comprises a drive motor and an indexer coupled to said drive motor for rotating said turret through one-quarter turn for every full rotation of said drive motor.

21. The apparatus of claim 20 further comprising clutch/brake means coupled between said drive motor and said indexer and switch means responsive to completion of one full revolution of said drive means for activating said clutch/brake means to abruptly halt said indexer and decouple drive from said motor to said indexer to limit rotation of the turret means to one-quarter turn each time the indexer is driven.

22. Taper means for applying a tape strip about a bundle of strip material comprising:

a jaw assembly;

means for linearly driving said jaw assembly toward and away from said materials;

said jaw assembly comprising a pair of spaced apart, swingable applicator jaws and linkage means coupling said linear driving means to said applicator jaws for swinging said jaws together when said jaw assembly is moved a predetermined linear distance toward said strip material:

each of said jaws having an applicator surface;

a plurality of tape strips arranged at spaced intervals along an elongated base strip;

means for transferring a tape strip from said base strip to said jaws when said jaw assembly is moved away from said material, said applying means applying said tape strip to said jaws so that only the opposite end surfaces of the tape strip engage the applicator surfaces of said jaws and so that the portion of the tape strip between said end surfaces extends between said jaws and is not engaged either by the jaws or the jaw assembly throughout the taping operation;

at least one of the exposed end surfaces of the tape strip opposite the end surfaces engaging said applicator surfaces being covered with an adhesive material, said exposed end surfaces being brought into engagement when the jaws are brought together, the portion of the tape strip between said end surfaces surrounding and assuming the contour of the strip material being taped when the end portions of the tape strip are affixed to one another;

spring means for swinging said jaws apart as said jaw assembly is moved away from said strip material in readiness to receive another tape strip.

23. The apparatus of claim 22, wherein said taper means further comprises a supply spool of tape including a base strip having tape strips adhesively mounted thereon;

a take-up spool;

means for advancing said base strip from said supply spool to said take-up spool;

a peel away guide plate having a tapered end adjacent said applicator jaws;

said base strip being pulled along one side of said guide plate around said tapered end and along the other side of said guide plate as it moves between said supply and said take-up spool, causing one tape strip to be peeled away from the base strip as the portion of the base strip carrying the tape moves around the tapered edge of said guide plate.

24. The apparatus of claim 22 further comprising an air wand adjacent the tapered edge of said guide plate for directing air against the tape as it is peeled away from the base strip and urging the tape toward said applicator jaws.

25. The apparatus of claim 24, wherein said applicator surfaces are formed of a resilient compressible material;

each jaw and each applicator surface having an opening;

conduit means coupling said openings to a vacuum source for holding a tape strip against said applicator surfaces.

26. The apparatus of claim 24 wherein only the end surface portion of one surface of the tape strip are covered with an adhesive to prevent the intermediate portions of the tape strip from adhering to the strip material.

* * * * *